United States Patent [19]

Post

[11] Patent Number: 4,556,371

[45] Date of Patent: Dec. 3, 1985

[54] CONSTANT FLOW POSITIVE DISPLACEMENT PUMP

[75] Inventor: Steven W. Post, Jonesboro, Ark.

[73] Assignee: FMC Corporation, Chicago, Ill.

[21] Appl. No.: 514,417

[22] Filed: Jul. 18, 1983

[51] Int. Cl.[4] ..... F04B 11/00

[52] U.S. Cl. ..... 417/539; 417/568

[58] Field of Search ..... 417/539, 517, 568; 91/492, 498, 485

[56] References Cited

U.S. PATENT DOCUMENTS

| | | | |
|---|---|---|---|
| 1,569,435 | 1/1926 | Myers | 417/539 X |
| 1,723,874 | 8/1929 | Lunge | 417/517 |
| 2,010,377 | 8/1935 | Sassen | 417/517 X |
| 2,114,565 | 4/1938 | Kovach | 417/539 X |
| 2,712,794 | 7/1955 | Humphreys | 91/485 |
| 2,882,831 | 4/1959 | Dannevig | 91/498 |
| 4,028,018 | 6/1977 | Audsley | 92/13.3 X |

FOREIGN PATENT DOCUMENTS

| | | | |
|---|---|---|---|
| 2706685 | 8/1978 | Fed. Rep. of Germany | 417/539 |
| 509039 | 7/1939 | United Kingdom | 417/539 |

*Primary Examiner*—Edward K. Look

*Attorney, Agent, or Firm*—Ronald C. Kamp; Richard B. Megley

[57] ABSTRACT

A triplex or quadruplex pump having pump pistons which are equally phased apart and driven by a common drive shaft so that the velocity, i.e., speed with direction of all pistons in the particular pump is equal to zero at all times.

7 Claims, 10 Drawing Figures

DISPLACEMENT
TDC
BDC
CAM ANGLE
0°
60°
120°
180°
240°
300°
360°

VELOCITY
$\frac{3}{\pi}A\dot{\theta}$
$-\frac{3}{\pi}A\dot{\theta}$
CAM ANGLE
0°
60°
120°
180°
240°
300°
360°

ACCELERATION
$\frac{9}{\pi^2}A\dot{\theta}^2$
$-\frac{9}{\pi^2}A\dot{\theta}^2$
CAM ANGLE
0°
60°
120°
180°
240°
300°
360°

PISTON 22
PISTON 24
PISTON 26
PISTON VELOCITY
(FLOW RATE)
D
D1
D3
I
0°
A
60°
120°
180°
240°
300°
360°
CAM ANGLE

CONSTANT FLOW POSITIVE DISPLACEMENT PUMP

BACKGROUND AND SUMMARY OF THE INVENTION

This invention relates to positive displacement pumps, and more particularly, to positive displacement pumps having either three or four pistons or plungers, which are commonly referred to as triplex and quadruplex pumps respectively.

The present invention arranges the pump pistons so that they are equally phased, i.e., 120° apart in the case of the triplex and phased 90° for the quadruplex pump, and impart a motion or displacement to the pistons from a drive end so that the average velocity, i.e., speed with direction, of all pistons in the particular pump is equal to zero at all times. The output flow rate resulting from this arrangement is theoretically constant, as is the input or suction flow rate. Accumulators, which were utilized with prior pumps as a means of dampening the output pulsations inherent therewith, are not needed with pumps of the present invention. Longer suction lines are also possible and charge pressure arrangements are not needed because the inlet flow is also constant, thereby eliminating the acceleration head phenomenon resulting from start and stop inlet flow always encountered with prior art pumps.

BRIEF DESCRIPTION OF THE DRAWING

The drawings are briefly described as follows.

DESCRIPTION OF THE PREFERRED EMBODIMENTS

Figure 1:
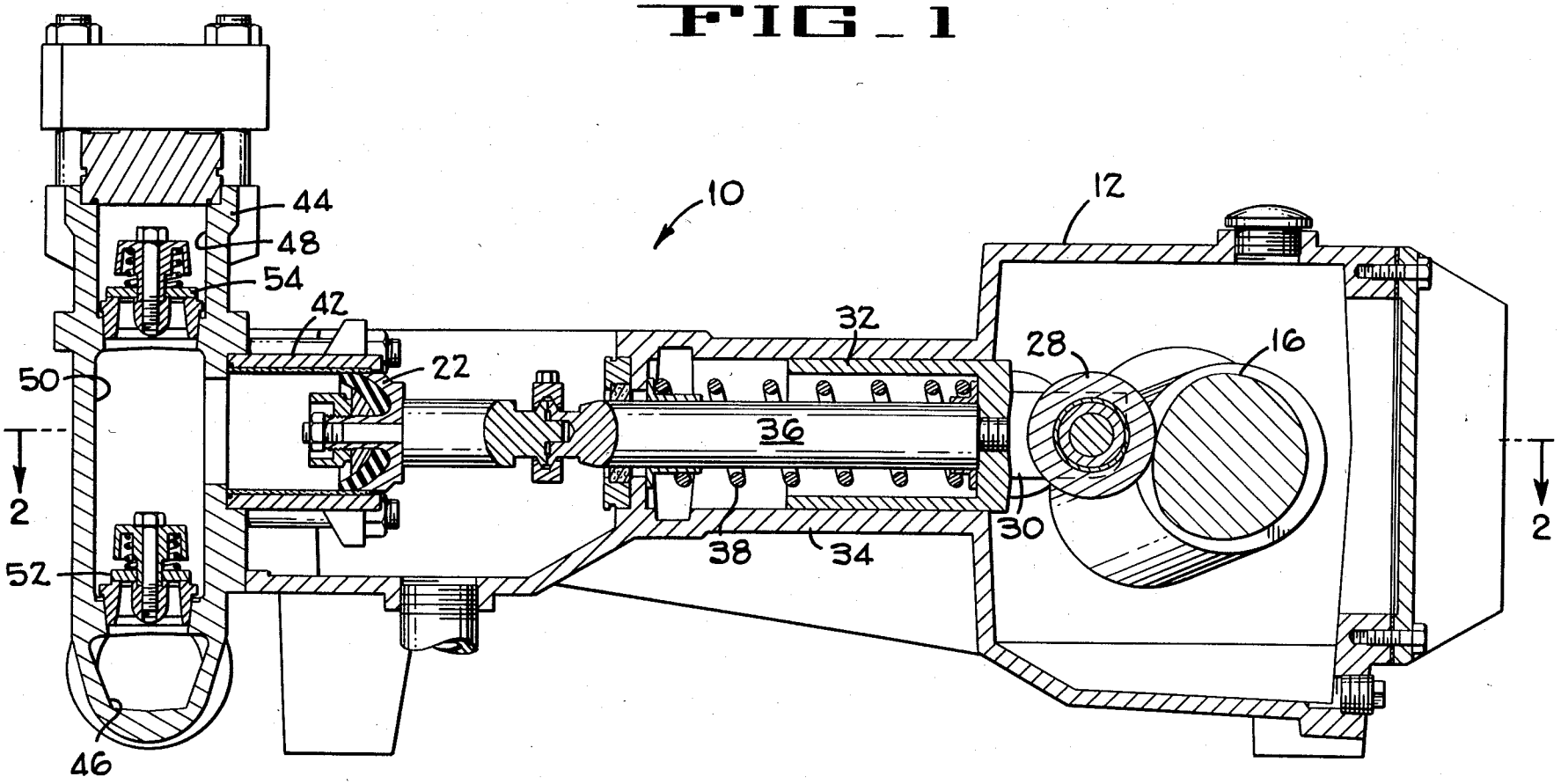
FIG. 1 is an elevational, cross-sectional view of a triplex pump according to the present invention.
Figure 2:
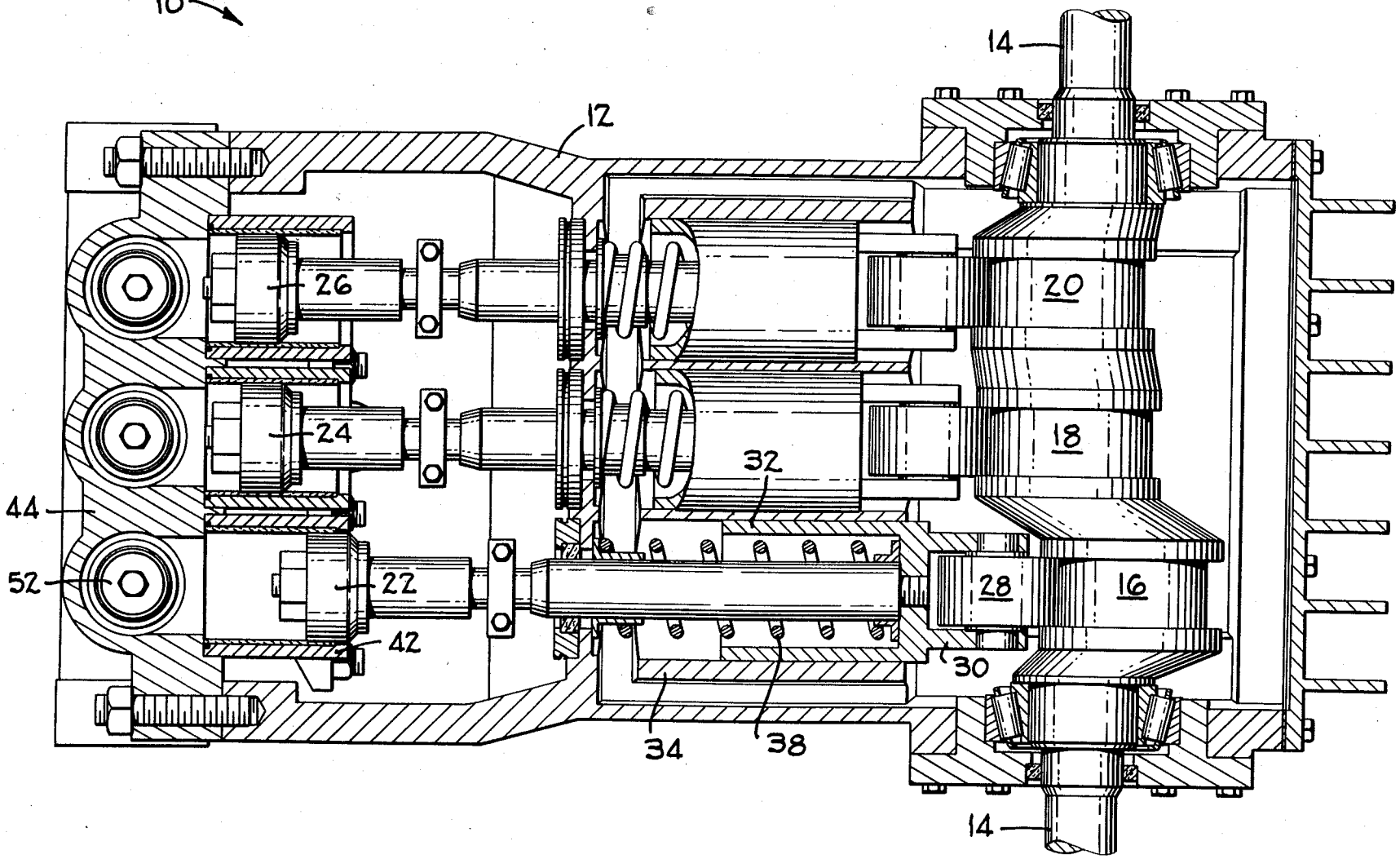
FIG. 2 is a cross-sectional view taken on line 2—2 of FIG. 1.

Referring now to FIGS. 1 and 2, a preferred embodiment of a triplex pump according to the present invention is indicated generally at 10 and has a casing or housing 12 with a drive shaft 14 rotatively mounted on bearings therein. Three cams 16, 18 and 20 are machined on the shaft 14 and are identically shaped but angularly spaced at 120° from each other. Each of the cams 16, 18 and 20 is arranged to stroke a piston or plunger 22, 24 and 26 respectively. Since the arrangements for stroking the three pistons are the same, a detailed description of one will be sufficient for a complete understanding.

A cam-follower roller 28 is rotatably mounted on the bifurcated closed end 30 of a tubular reciprocating member 32 and engages the cam 16. The member 32 is reciprocally mounted within one of the cylinders 34 machined in the housing 12 and is attached to the piston 22 by a rod 36. For ease of assembly and repair the rod 36 is arranged to be separable. A compression spring 38 is trapped between the closed end of number 32 and the bottom of cylinder 34 and urges roller 28 into contact with the cam 16. The piston 22 sealing engages, and is reciprocable within a cylinder 42 secured to a manifold assembly 44 releasably attached to the housing 12. Manifold assembly 44 includes an intake chamber 46, an output chamber 48 and a pumping chamber 50 communicating with the cylinder 42. A check valve 52 separates the intake chamber 46 from the pumping chamber 50 and permits fluid flow only from the intake chamber to the pumping chamber. A similar check valve 54 separates the output chamber 48 from the pumping chamber 50 and permits fluid flow only from the pumping chamber 50 into the output chamber 48. Reciprocation of the piston 22 in response to the roller 28 following the cam 16 will result in fluid being drawn from the intake chamber 46 into the pumping chamber 50 and then forced into the output chamber 48.

Figure 3:
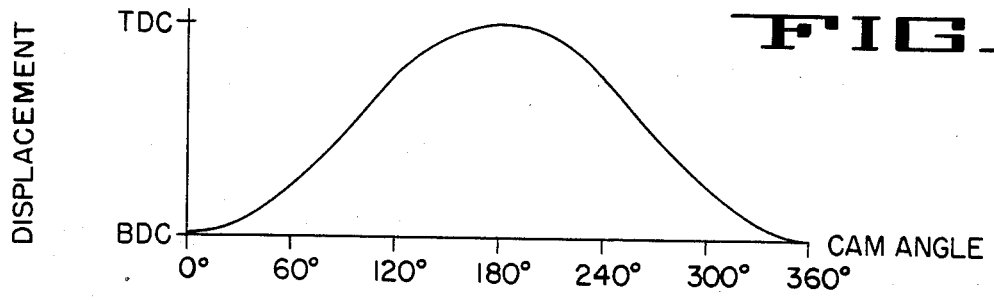
FIG. 3 is a graph of the piston displacement as a function of cam angle or rotation for a single cylinder of the triplex pump shown in FIGS. 1 and 2.
Figure 4:
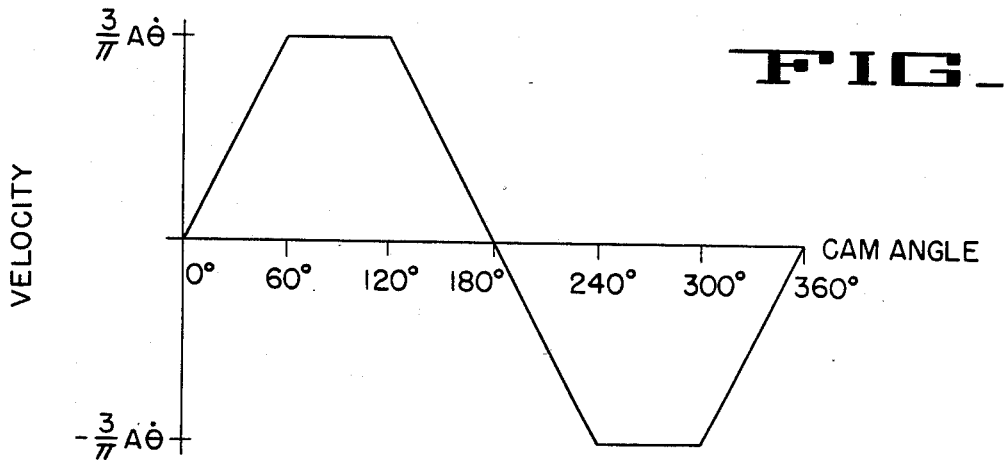
FIG. 4 is a graph of piston velocity as a function of cam angle for the cylinder referred to in FIG. 3.
Figure 5:
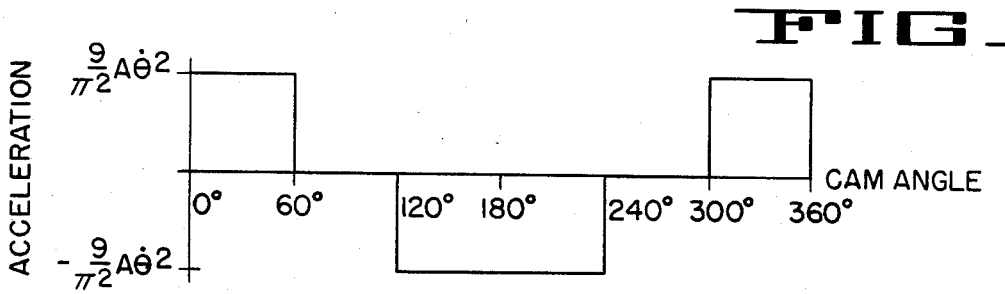
FIG. 5 is a graph of piston acceleration as a function of cam angle for the cylinder referred to in FIGS. 3 and 4.

Referring now to FIG. 3, the displacement of the piston, e.g., piston 22, is shown as a function of angular displacement of cam 16 as the shaft 14 is rotated. The cam 16 is provided with a shape or profile such that the piston displacement is as shown in FIG. 3. This curve is defined by a pair of parabolas, one between 0° and 60° and between 300° and 360° and the other between 120° and 240° interconnected by two straight lines, one between 60° and 120° and the other between 240° and 300°. The velocity curve of FIG. 4 represents the rate of fluid flow generated by the piston 22, and is the first derivative with respect to time of the curve shown in FIG. 3. Flow increases at a constant rate through the 0° to 60° portion of the curve, is constant through the next 60° and decreases at a constant rate for the next 120°, is constant between 240° and 300° and then increases at a constant rate between 300° and 360°. The maximum velocity is $3/\pi A\theta$, where A is $\frac{1}{2}$ piston stroke and $\theta$ is the rotation speed of the drive shaft or cam. The acceleration curve of FIG. 5 is the first derivative with respect to time of the velocity curve of FIG. 4. The maximum acceleration is $9/\pi^2 A\theta^2$ and occurs between 0° and 60° and between 300° and 360°. Between 120° and 240° the acceleration is negative, but has an absolute value which is the same. At all other cam angles the acceleration is zero.

Figure 6:
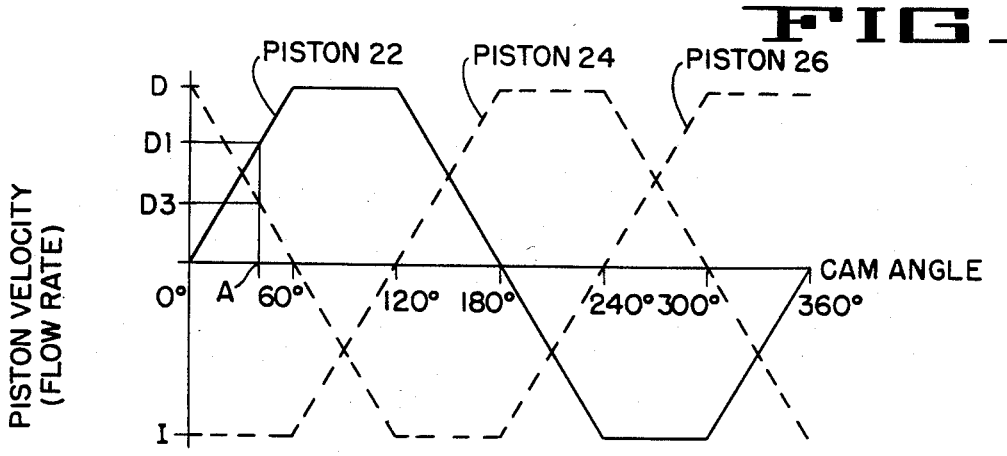
FIG. 6 is a graph of piston velocity or flow rate as a function of cam angle for all three of the pistons in the triplex pump shown in FIGS. 1 and 2.

When the output flow rate curves for all three cylinders in the triplex pump are combined with the cylinders phased at 120° apart from each other, the result is as shown in FIG. 6. The negative portion of the velocity curve in FIG. 6, i.e., that portion below the X-axis, represents the intake or suction of fluid by each piston, while the positive portion, i.e., that portion above the X-axis, represents the output flow rate. The total output flow rate is the sum of the three piston's positive velocity curves which results in a constant output at the value D displayed on the Y-axis of FIG. 6. Between 0° and 60° the total output is the sum of positive velocity curves for pistons 22 and 26; piston 24 is in its suction or intake phase and thus has no affect on output. Thus, for any angle between 0° and 60° the total output is the sum of D1, the output contributed by piston 22, and D3, the output contributed by piston 26. The sum of D1 and D3 is equal to D. Between 60° and 120°, the total output D is solely the contribution of piston 22, which is constant at D. During this range of cam angle, both pistons 24 and 26 are in their suction stroke. Between 120° and 180°, the total output is the sum of the outputs from the piston 22 and 24; the piston 26 remaining in its suction stroke. Between 180° and 240° the total output D is solely contributed by, and equal to, the constant velocity of piston 24. Between 240° and 300° the velocity of pistons 24 and 26 together determine the total output, and between 300° and 360° the total output D is solely contributed by, and equal to, the constant velocity of piston 26. Thus, the total output of the triplex pump 10 remains constant.

It is also important to note that similar relationships are obtained in the suction or intake side of the pump. The intake flow rate I remains constant at an absolute value equal to C. Between 0° and 60°, only the piston 24 is in its suction stroke and at a constant velocity equal to I. Between 60° and 120° piston 24 decreases velocity, on an absolute scale, at a constant rate while piston 26 begins its suction stroke increasing at the same absolute constant rate so that the sum of the two at any angle therebetween is equal to I. The piston 26 has a constant velocity equal to I between 120° and 180°, during which time both pistons 22 and 24 are in a portion of their output or discharge stroke. Between 180° and 240° pistons 22 and 26 are in their suction strokes and the sum of their intake velocities is equal to I. Between 240° and 300° only the piston 22 is in a suction mode and moving at a constant velocity equal to I. Finally, between 300° and 360° the intake flow rate is the sum of the suction flow rates for pistons 22 and 24. The total intake or suction flow rate for the triplex pump is, therefore, theoretically constant. Since flow fluctuations on the intake side of the pump are in effect modulated within the intake manifold 46, the intake pipe or line connected to this manifold is subjected to a steady and uniform flow. Since fluid is not being decelerated and accelerated within the intake pipe, it can be made longer without encountering cavitation problems within the pump, or alternatively, can be made of a smaller diameter for any comparable length vis-a-vis, a conventional triplex pump.

The triplex pump 10 FIGS. 1 and 2 can be made into a quadruplex version by simply adding a fourth cylinder and piston with an identical mechanism to engage a fourth cam. The four pistons will be phased 90° apart, rather than 120°, and the shape or profile of each cam would then have to be changed as will be described hereinafter. Strength considerations may dictate placing an additional bearing support for the drive shaft 14 intermediate those bearings depicted in FIG. 2, or otherwise rearranging the four cylinders to reduce and/or absorb the stresses encountered by the drive shaft or shafts.

Figure 7:
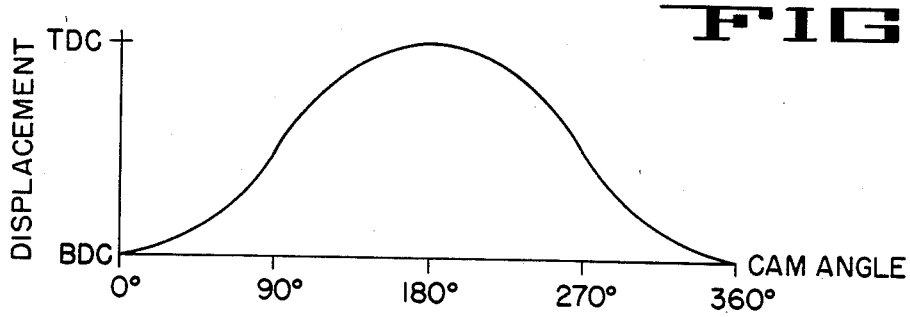
FIG. 7 is a graph of the piston displacement as a function of cam angle or rotation for a single cylinder of a quadruplex pump according to the present invention.
Figure 8:
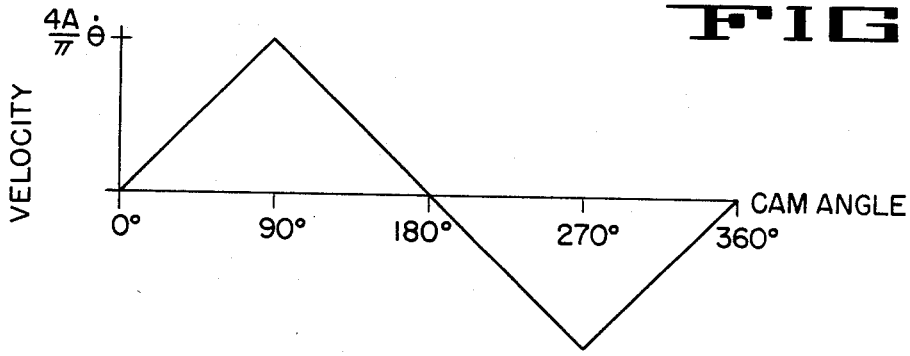
FIG. 8 is a graph of piston velocity as a function of cam angle for the cylinder referred to in FIG. 7.
Figure 9:
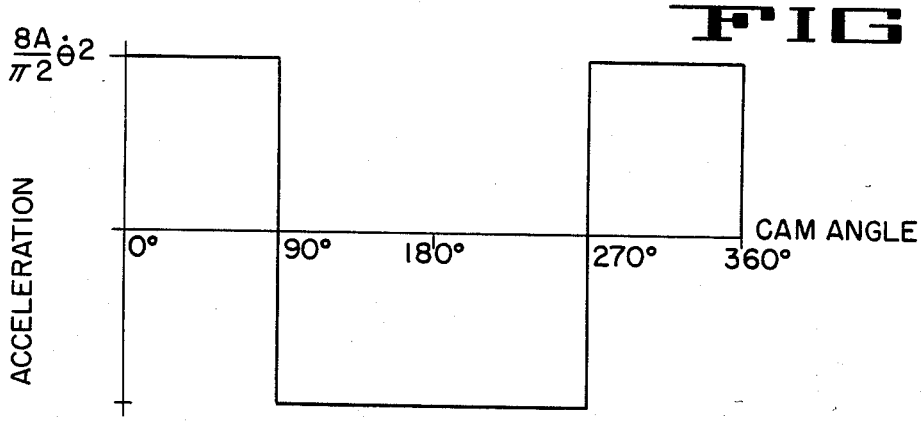
FIG. 9 is a graph of piston acceleration as a function of cam angle for the cylinder referred to in FIGS. 7 and 8.

Each of the cams for the quadruplex pump has a shape or profile capable of producing a displacement curve for the associated piston as shown in FIG. 7. This curve is composed of two parabolas; one between 270° and 360° and between 0° and 90° and the other between 90° and 270°. The inflection points between the two parabolas are at 90° and 270°. The velocity curve which also represents flow rate, resulting from this displacement is shown in FIG. 8. The maximum absolute values of velocity are achieved at 90° and 270° which values are equal to $4/\pi A\theta$. The acceleration curve, shown in FIG. 9, discloses that the acceleration is never zero, except as it crosses the X-axis at an infinite slope, and has a maximum value of $8/\pi^2 A\theta^2$.

Figure 10:
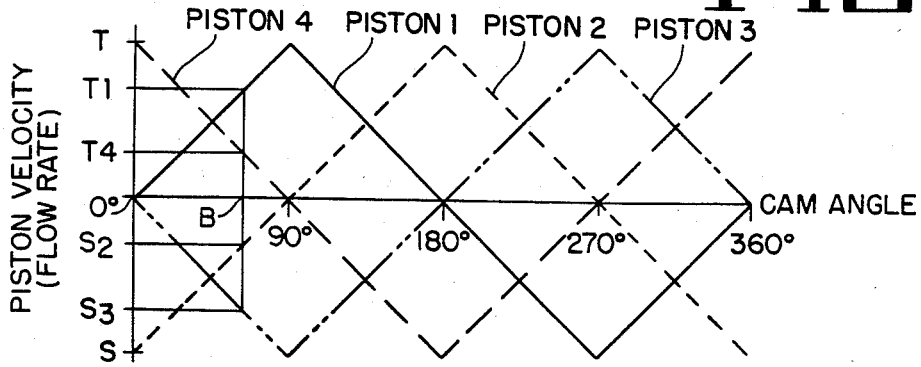
FIG. 10 is a graph of piston velocity showing the velocity or flow rate for each of the four pistons in a quadruplex pump according to the present invention.

FIG. 10 illustrates the flow rate produced by all four of the pistons in a quadruplex pump. As with FIG. 6, those portions of the curves in FIG. 10 above the X-axis are positive and represent output flow, while those portions below the X-axis represent suction or intake flow. The combined total flow from all four pistons is theoretically constant at an output of T as shown on the Y-axis of FIG. 10, and the combined total intake or suction flow of all four pistons is constant as shown as S; the absolute value of S being equal to T. At 0°, the total output T is the maximum flow rate resulting from piston 4. As the drive shaft rotates so that the cam angle goes from 0° to 90°, the velocity, i.e., flow rate, of piston 4 decreases at a constant rate, while the velocity or flow rate of piston 1 increases at the same constant rate. As a result the combined output created by pistons 4 and 1 remains constant at T from 0° to 90°. That is, at any cam angle $\beta$ therebetween, the sum of T1 and T4 equals T. At 90° piston 1 has reached its maximum velocity, resulting in a flow rate equal to T and from there to 180° piston 1 decreases in velocity or flow rate as the velocity of piston 2 is increasing at an offsetting rate, thus maintaining the total output equal to T. Similarly, between 180° and 270° piston 3 increases and piston 2 decreases in velocity to maintain constant combined output equal to T, and between 270° and 360° pistons 3 and 4 combine to maintain output at T. On the suction side, i.e., below the X-axis, the pistons are paired off to maintain a constant suction flow S. Between 0° and 90° pistons 2 and 3 provide individual flow rates S2 and S3 such that their sum is the total suction flow and remains constant at S. Pistons 3 and 4 do the same between 90° and 180°, pistons 1 and 4 between 180° and 270°, as do pistons 1 and 2 between 270° and 360°. Thus, the suction flow remains constant at level S. While the cam profiles for the triplex and quadruplex pump are different the net result of the total flow rate from all pistons in both pumps is maintained constant because the sum of the velocity vectors for all pistons in the particular pump is equal to zero at all times.

It should be noted that for both the triplex and the quadruplex pumps the maximum acceleration of fluid in the individual cylinders is less than that resulting from prior art pumps. The lower accelerations provide the advantage of reducing acceleration head cavitation in the intake manifold and pumping chambers, which permits pumps of the present invention to be operated at higher rotational speeds (rpm's). To achieve any given flow rate, it is, therefore, possible with the present invention to utilize smaller displacement pumps operated at higher speeds.

While two embodiments of the present invention have been disclosed herein, it will be appreciated that various changes and modifications may be made thereto without departing from the spirit of the invention as defined by the scope of the appended claims.

What is claimed is:

1. A reciprocating power pump capable of pumping a non-lubricating fluid comprising:

a housing having a drive shaft rotably mounted therein;

a plurality of cylinders, numbering no less than three and no more than four, each having a pumping chamber, in said housing;

an intake and output manifolds common to all cylinders connected to said housing adjacent said pumping chambers;

an intake check valve for each cylinder permitting flow only from said intake manifold to the associated pumping chamber;

an output check valve for each cylinder permitting flow only from the associated pumping chamber to said output manifold;

a plurality of external cams, equal to the number of cylinders, on said drive shaft;

a roller follower engaging each cam;

a piston connected to each follower and reciprocable within the associated cylinder;

a seal carried by each piston and sealingly engaging the associated cylinder;

said cams having identical profiles angularly spaced relative to each other; and said cams causing said pistons to reciprocate such that the sum of the velocity vectors of all pistons in equal to zero.

2. The invention according to claim 1, wherein:

said plurality of cams comprises four cams angularly spaced 90 degrees apart.

3. A positive displacement triplex pump comprising:

a casing having a rotatable drive shaft;

three cams affixed to said drive shaft for rotation therewith;

a follower engaging each of said cams;

a piston connected to each follower;

the cams having identical profiles angularly spaced 120° apart;

each profile causing reciprocation of the associated piston with a displacement defined by a pair of equal but oppositely directed parabolas separated and interconnected by two straight lines, as representative of piston displacement when plotted on cartesian coordinates as a function of cam rotation angle, each line extending at least 60° of cam rotation.

4. A positive displacement triplex pump comprising:

a casing having a rotatable drive shaft;

three cams affixed to said shaft for rotation therewith;

a follower engaging each of said cams;

a piston connected to each follower;

the cams having the same profiles positioned at equal angular intervals on said shaft;

the profiles causing movement of said pistons so that the sum of their velocities is zero at all times.

5. A positive displacement quadruplex pump comprising:

a casing having a rotatable drive shaft;

four cams affixed to said shaft;

a follower engaging each of said cams;

a piston connected to each follower;

the cams having identical profiles positioned at equal angular intervals on said shaft;

the profiles causing movement of said pistons so that the sum of their velocities is zero at all times.

6. A position displacement quadruplex pump comprising:

a casing having a rotatable drive shaft;

four cams affixed to said shaft;

a follower engaging each of said cams;

a position connected to each follower;

the cams having identical profiles angularly spaced at 90 degrees;

the profile of each cam causing the associated piston to be displaced as defined by a pair of equal but oppositely directed parabolas as representative of piston displacement when plotted on cartesian coordinates as a function of cam rotation angle.

7. A positive displacement quadruplex pump comprising:

a casing having a rotatable drive shaft;

four cams affixed to said shaft;

a follower engaging each of said cams;

a piston connected to each follower;

the cams having the same profiles equiangularly positioned on said shaft;

each profile causing the movement of the associated piston so that its velocity alternately increases and decreases at a constant absolute rate.

* * * * *